US007858164B2

(12) United States Patent
Tonooka et al.

(10) Patent No.: US 7,858,164 B2
(45) Date of Patent: Dec. 28, 2010

(54) END FRAY SOLUTION FOR TEXTILE STRUCTURE

(75) Inventors: Takashi Tonooka, Shizuoka (JP); Hiroki Yamaguchi, Kanagawa (JP); Koushirou Hashimoto, Kanagawa (JP); William Schrepple, Maple Shade, NJ (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 856 days.

(21) Appl. No.: 11/696,043

(22) Filed: Apr. 3, 2007

(65) Prior Publication Data

US 2007/0226971 A1 Oct. 4, 2007

Related U.S. Application Data

(60) Provisional application No. 60/788,822, filed on Apr. 3, 2006.

(51) Int. Cl.
*B60R 21/16* (2006.01)
*B32B 1/08* (2006.01)

(52) U.S. Cl. ..... 428/36.1; 428/36.3; 428/36.9; 428/36.92

(58) Field of Classification Search ..... 428/36.1, 428/36.3, 36.9, 36.91, 36.92
See application file for complete search history.

(56) References Cited

U.S. PATENT DOCUMENTS 3,393,110 A 7/1968 Slade
4,560,427 A 12/1985 Flood
4,610,688 A 9/1986 Silverstrini et al.
4,784,886 A 11/1988 Monget et al.
4,834,755 A 5/1989 Silvestrini et al.
4,891,256 A 1/1990 Kite, III et al.
5,401,409 A 3/1995 Hartmann
6,265,039 B1 7/2001 Drinkwater et al.
6,589,468 B1 7/2003 Schmitt
6,637,490 B1 10/2003 Azulay
6,936,553 B2 8/2005 Von Samson-Himmelstjerna
2004/0235381 A1 11/2004 Iwasaki et al.
2004/0247002 A1 12/2004 Tojo
2005/0124249 A1 6/2005 Uribarri
2007/0166495 A1* 7/2007 Sellis et al. ..... 428/36.1

FOREIGN PATENT DOCUMENTS

JP 2003160164 6/2003

* cited by examiner

*Primary Examiner*—Michael C Miggins
(74) *Attorney, Agent, or Firm*—Robert L. Stearns; Dickinson Wright, PLLC

(57) ABSTRACT

An apparatus comprising a textile extending a length between a first end and a second end. The textile also extends a dimension transverse to the length. The dimension can be a width or a circumference. The apparatus also includes a first bonded portion adjacent to the first end to limit fraying at the first end. The apparatus also includes a second bonded portion spaced from the first bonded portion along the length to limit fraying at the first end.

10 Claims, 1 Drawing Sheet

END FRAY SOLUTION FOR TEXTILE STRUCTURE

CROSS-REFERENCE TO RELATED APPLICATIONS

This application claims the benefit of U.S. Provisional Patent Application Ser. No. 60/788,822 for an END FRAY SOLUTION FOR TEXTILE STRUCTURE, filed on Apr. 3, 2006, which is hereby incorporated by reference in its entirety.

BACKGROUND OF THE INVENTION

1. Field of the Invention

The invention relates to limiting the fraying at an end of a textile structure.

2. Description of Related Art

When a textile structure is cut to a desired size, the ends of the textile structure can fray. To overcome this problem, the end of the textile structure can be dipped in a viscous material that is dried and set. The end of the textile structure can also be melted to reduce the likelihood of fraying.

SUMMARY OF THE INVENTION

An apparatus comprising a textile extending a length between a first end and a second end. The textile also extends a dimension transverse to the length. The dimension can be a width or a circumference. The apparatus also includes a first bonded portion adjacent to the first end to limit fraying at the first end. The apparatus also includes a second bonded portion spaced from the first bonded portion along the length to limit fraying at the first end.

BRIEF DESCRIPTION OF THE DRAWINGS

Advantages of the present invention will become more readily appreciated when considered in connection with the following detailed description and appended drawings, wherein.

DETAILED DESCRIPTION OF THE PREFERRED EMBODIMENT

Figure 1:
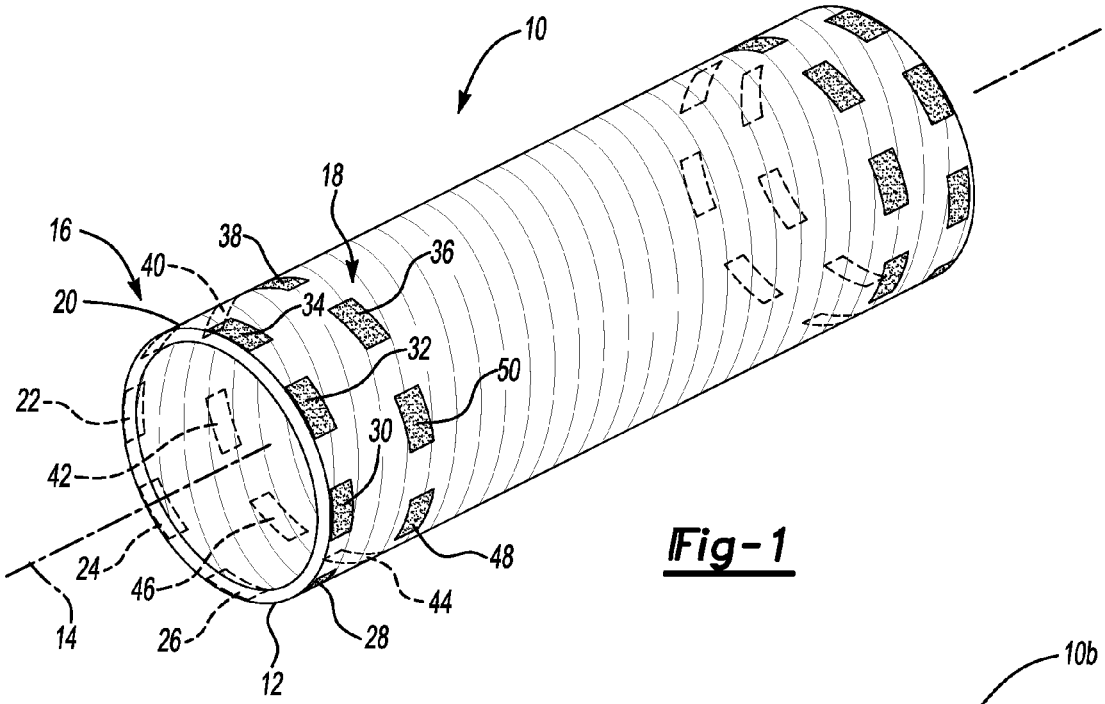
FIG. 1 is a perspective view of a tubular textile structure according to a first embodiment of the invention.

A plurality of different embodiments of the invention are shown in the Figures of the application. Similar features are shown in the various embodiments of the invention. Similar features have been numbered with a common reference numeral and have been differentiated by an alphabetic designation. Also, to enhance consistency, features in any particular drawing share the same alphabetic designation even if the feature is shown in less than all embodiments. Similar features are structured similarly, operate similarly, and/or have the same function unless otherwise indicated by the drawings or this specification. Furthermore, particular features of one embodiment can replace corresponding features in another embodiment unless otherwise indicated by the drawings or this specification.

Referring now to FIG. 1, in a first exemplary embodiment of the invention, a textile 10 extends a length to a first end 12. A textile 10 is tubular and the length extends parallel to a center axis 14 of the tubular textile 10. The first end 12 defines a dimension transverse to the length. In the first exemplary embodiment of the invention, the first end 12 defines a circumference. The textile 10 includes a first bonded portion 16 adjacent to the first end 12. The first bonded portion 16 limits fraying at the first end 12. The textile 10 also includes a second bonded portion 18 spaced from the first bonded portion 16 along the length. The second bonded portion 18 also limits fraying at the first end 12. The first and second bonded portions 16, 18 extend transverse to the length less than the circumference of the textile 10. In other words, the neither the first nor second bonded portions 16, 18 extend the full circumference of the textile 10 in the first embodiment of the invention.

The arrangement of the first and second bonded portions 16, 18 allow the first end 12 to be fitted around another structure. For example, the arrangement of the first and second portions 16, 18 allows the first end 12 to expand slightly to be drawn over some structure to be protected by the textile 10, such as a fitting. If the entire circumference of the first end 12 had been bonded, the first end 12 would not be as expandable as desired for some operating environments. The second bonded portion 18 cooperates with the first bonded portion 16 to reduce the likelihood of fraying. The first and second bonded portions 16, 18 are spaced from one another relative to the circumference. In other words, the first and second bonded portions 16, 18 are offset with respect to one another about the circumference of the textile 10. The cooperation between the first and second bonded portions 16, 18 allows the textile 12 to stretch or expand at the first end 12 while concurrently reducing the likelihodd of fraying.

The first bonded portion 16 and the second bonded portion 18 of the first exemplary embodiment of the invention, include first and second pluralities of the discrete sub-portions along the circumference. For example, the first bonded portion 16 includes sub-portions 20-34. The second bonded portion 18 includes sub-portions 36-50. The first plurality of discrete sub-portions 20-34 are offset from the second plurality of discrete sub-portions 36-50 along the circumference.

The textile 10 can be formed from any textile forming process, including, but not limited to, braiding, weaving, and knitting. Also, the textile 10 can be formed from any material used in textile formation. The first exemplary embodiment of the invention is braided from material that is meltable.

Figure 2:
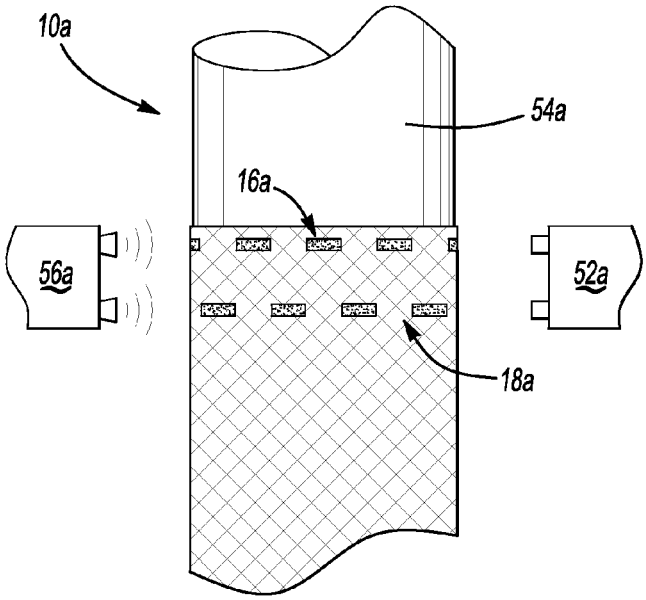
FIG. 2 is a schematic view showing first and second bonded portions being formed in a tubular textile according to a second embodiment of the invention.

FIG. 2 is a schematic drawing showing various methods for forming first and second bonded portions 16*a*, 18*a* in a textile 10*a*. In one embodiment of the invention, a collar 52*a* is heated and pressed against the textile 10*a*. The textile 10*a* surrounds a mandrel 54*a*. The mandrel 54*a* can be cooled to prevent the textile 10*a* from adhering to the mandrel 54*a*. In another embodiment of the invention, an ultrasonic wave generator 56*a* can be directed at the textile 10*a*.

Figure 3:
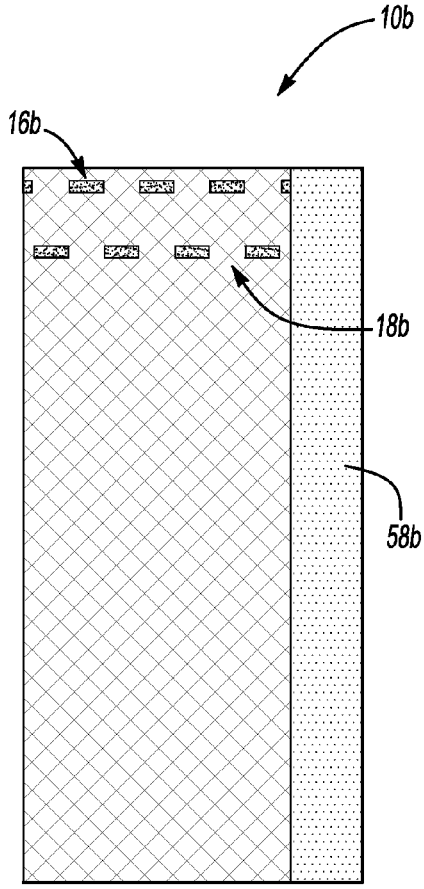
FIG. 3 is a top view of a flat textile according to a third embodiment of the invention.

Referring now to FIG. 3, in a third exemplary embodiment of the invention, a flat textile 10*b* is formed with a first bonded portion 16*b* and a second bonded portion 18*b*. An adhesive tape member 58*b* is attached to the textile 10*b* and extends along the length of textile 10*b*.

The textiles of exemplary embodiments of the invention can be formed with at least two different materials to enhance the qualities and characteristics of the bonded portions. For example, a textile can be formed from (1) 0.015 inch diameter Nylon—6,6 heat-stabilized monofilament and (2) 0.010 inch diameter PET (polyethylene terephthalate) monofilament. The bonded portions of the textile can be formed by ultrasonic welding wherein discrete portions of the textile are heated to or beyond the melting point. The bonded portions are the blend of the two materials. Bonded portions formed by ultrasonic welding will be stronger than had the textile been formed exclusively with PET. The bonded portions formed from a textile of different materials thus constitute an alloy—a mixture of two materials with properties different that the properties of the two materials individually. The alloy composition can be varied by the selection of materials and/or the selection of proportion of materials. The proportion can be varied by varying the size of the filaments forming the textile and/or the ratio of filaments of one material to filaments of a second material.

The selection of the two materials can thus be made in view of the properties desired of the alloy that is formed from the blend of the two different materials melted together. In other words, the materials can be selected not necessarily based exclusively on the properties desired from the length of the textile between the ends. For example, an exemplary textile may function in an environment requiring resistance to high temperatures. In view of this consideration, there may be a plurality of different materials that can be used individually or in combinations to form the textile resistant to high temperature. An exemplary embodiment of the present, broader invention provides that at least two different materials are selected from the plurality of materials based on the properties desired of the bonded portions that will be formed in the textile. The materials selected will thus satisfy the desired performance characteristics of the textile along its length and at its end.

In another example, operating conditions along the length of the textile may be secondary to the properties desired of the bonded portions that will be formed in the textile. The textile may operate in an environment that is moderate with respect to temperature, vibration, electromagnetic fields, or any other condition that textiles shield against. In addition, the textile may be required to exhibit relatively high strength or toughness at one end. Other properties desired of the bonded portions include, but are not limited to, flexibility and softness. In view of these considerations, an exemplary embodiment of the present, broader invention provides that at least two different materials are selected that will result in the bonded portions having relatively high strength or toughness. Several different combinations of materials may be capable of producing the desired qualities of relatively high strength or toughness in the bonded portions. A single combination of materials can be selected from the several different combinations based on the operating conditions along the length of the textile. The materials selected will thus satisfy the desired performance characteristics of the bonded portions at the end of the textile as well as the desired performance characteristics along the length of the textile.

Many modifications and variations of the present invention are possible in light of the above teachings. It is, therefore, to be understood that within the scope of the appended claims, the invention may be practiced otherwise than as specifically described.

What can be claimed is:

1. An apparatus comprising:

a textile extending a length between a first end and a second end and also extending a dimension transverse to said length being one of a width and a circumference and having a first bonded filament portion disposed adjacent to said first end to limit fraying at said first end, said first bonded filament portion including a first plurality of discrete sub-portions of bonded interlaced filaments, each of said first sub-portions being spaced from one another along the transverse dimension by a first plurality of non-bonded interlaced filament sub-portions and also having a second bonded portion spaced from said first bonded portion along said length by interlaced non-bonded filaments to limit fraying at said first end, said second bonded portion including a second plurality of discrete sub-portions of bonded interlaced filaments, each of said second sub-portions being spaced from one another along the transverse dimension by a plurality of second non-bonded interlaced filament sub-portions.

2. The apparatus of claim 1 wherein said first plurality of discrete sub-portions are offset from said second plurality of discrete sub-portions along said dimension.

3. The apparatus of claim 1 wherein said first bonded portion and said second bonded portion are further defined as spaced from one another along said dimension.

4. The apparatus of claim 3 wherein said textile is further defined as a sleeve surrounding and axis and said dimension is further defined as a circumference and said first bonded portion and said second bonded portion are further defined as spaced from one another circumferentially about said axis.

5. The apparatus of claim 3 wherein said textile is further defined as flat and axis and said dimension is further defined as a width and said first bonded portion and said second bonded portion are further defined as spaced from one another along said width.

6. The apparatus of claim 1 wherein at least one of said first bonded portion and said second bonded portion extend transverse to said length a distance less than said dimension.

7. The apparatus of claim 6 wherein both of said first bonded portion and said second bonded portion extend transverse to said length a distance less than said dimension.

8. The apparatus of claim 1 wherein at least one of said first bonded portion and said second bonded portion are melted portions of said textile.

9. The apparatus of claim 8 wherein both of said first bonded portion and said second bonded portion are melted portions of said textile.

10. An apparatus comprising:

a textile formed from two different materials extending a length between a first end and a second end and also extending a dimension transverse to said length being one of a width and a circumference and having a first bonded portion disposed adjacent to said first end to limit fraying at said first end, said first bonded portion including a first plurality of discrete sub-portions of bonded interlaced filaments, each of said first sub-portions being spaced from one another along the transverse dimension by a first plurality of non-bonded interlaced filament sub-portions and also having a second bonded portion spaced from said first bonded portion along said length to limit fraying at said first end, said second bonded portion including a second plurality of discrete sub-portions of bonded interlaced filaments, each of said second sub-portions being spaced from one another along the transverse dimension by a plurality of second non-bonded interlaced filament sub-portions wherein the bonded portions define an alloy formed from a blend of the two different materials melted together.

* * * * *